United States Patent [19]

Ducote

[11] 4,062,696

[45] Dec. 13, 1977

[54] PURIFICATION OF CONTAMINATED ALUMINA SCAVENGERS OF ALUMINUM REDUCTION CELL EFFLUENT DRY SCRUBBER SYSTEMS

[75] Inventor: Hebon J. Ducote, Saratoga, Calif.

[73] Assignee: Kaiser Aluminum & Chemical Corporation, Oakland, Calif.

[21] Appl. No.: 709,025

[22] Filed: July 27, 1976

[51] Int. Cl.[2] ..... B08B 3/12

[52] U.S. Cl. ..... 134/1; 55/242; 55/243; 134/25 R; 204/67; 252/411 R; 252/412; 252/414; 252/420

[58] Field of Search ..... 134/1, 25 R; 55/242, 55/243, 71; 252/411 R, 412, 414, 420; 204/67, 247

[56] References Cited

U.S. PATENT DOCUMENTS

| | | | |
|---|---|---|---|
| 2,919,174 | 12/1959 | Pring | 204/67 |
| 3,222,221 | 12/1965 | Branson | 134/1 |
| 3,231,513 | 1/1966 | Graves et al. | 134/1 X |
| 3,503,184 | 3/1970 | Knapp et al. | 55/71 |
| 3,780,497 | 12/1973 | Muhlrad | 204/67 UX |
| 3,827,955 | 8/1974 | Bahri et al. | 204/67 |
| 3,849,196 | 11/1974 | Halloway et al. | 134/1 |
| 4,006,066 | 2/1977 | Sparwald | 204/67 |

*Primary Examiner*—S. Leon Bashore
*Assistant Examiner*—Marc L. Caroff
*Attorney, Agent, or Firm*—Paul E. Calrow; Andrew E. Barlay

[57] ABSTRACT

Metallic and nonmetallic impurities are removed from contaminated alumina scavengers, such as employed for the purification of aluminum reduction cell effluents in dry scrubber systems, by preparing a slurry of the contaminated alumina and subjecting the slurry to an ultrasonic treatment. The treatment removes a significant quantity of the impurities, which will be dispersed in the liquid phase and can be readily separated from the purified alumina. The cleaned alumina is suitable for return to the dry scrubbing system or to be used as feed in the electrolytic aluminum reduction cells.

9 Claims, 2 Drawing Figures

PURIFICATION OF CONTAMINATED ALUMINA SCAVENGERS OF ALUMINUM REDUCTION CELL EFFLUENT DRY SCRUBBER SYSTEMS

BACKGROUND OF THE INVENTION

In the Hall-Heroult process of producing aluminum by the electrolytic reduction of alumina, using a fluoridic molten flux as conductive medium, solid and gaseous effluents are emitted from the reduction cells. These effluents include carbon particles from the anodes employed, volatilized metallic and nonmetallic impurities from the alumina feed and other gaseous compounds generated by the electrolytic process. Strict environmental and safety regulations require capture of these undesirable effluents and a common method employed for offgas purification involves the utilization of dry scrubber systems. Dry scrubber systems presently in use in aluminum reduction plants use alumina as a sorbent for the capture of harmful effluents. The reasons for the use of alumina in these scrubbers are many fold; aside from its well-known sorptive capacity, including its capability of combining with the fluorides of the offgas, the exhausted alumina sorbent can be employed as feed for the reduction cells, thus eliminating a disposal problem. Nevertheless, there are significant problems associated with the recycling of the impurity-laden alumina scavenger as feed to the reduction cells. One of the main problems results from the high metallic impurity level of the alumina scavenger to be charged to the cells. Typical metallic impurities, which have been captured by the alumina in the dry scrubber system include iron, nickel and vanadium; also significant quantities of magnesium, calcium and sodium will be retained in the alumina together with phosphor pentoxide. The major nonmetallic impurity which contaminates the alumina of the dry scrubber system is carbon which results from the degradation and incomplete burning of the carbon electrodes, such as prebaked or Soederberg anodes, commonly employed in the reduction cells. Return of these impurities to the cells with the spent alumina scavenger enriches the produced aluminum metal in undesired metallic and nonmetallic impurities; the high carbon content of the feed may cause additional feeding problems, such as sudden combustion of the carbon in the cell at the high operating temperatures; and the current efficiency of the cell is considerably reduced.

To overcome these undesirable effects it has been suggested to employ a fluidized bed reactor containing alumina for the removal of fluoridic and other impurities from the cell offgases. The partially purified offgases, containing entrained alumina particles, are then introduced into an electrostatic precipitator where the offgas purification is completed and where simultaneously grain size classification of the impurity-laden alumina, entrained in the offgas, takes place. The fine fraction obtained by the electrostatic precipitation, which has been found to contain most of the undesirable impurities, is subjected to pyrohydrolysis to remove its fluoride content, while the coarse fraction is recycled to the cell as feed after a thermal treatment to remove its HF content. The HF-free alumina which is obtained after pyrohydrolysis is still highly contaminated in noncombustible and nonvolatilizable metallic and nonmetallic impurities and is unsuitable for recycle to the reduction cells and thus poses a problem of disposal. While the above-described system avoids reintroduction of significant quantities of impurities to the reduction cells, it requires close control of operations, complicated mechanical and electrical equipment and still results in a large volume of impure alumina which cannot be utilized as feed for the reduction cells.

It has now been discovered that these disadvantages of the prior art systems can be readily resolved and eliminated by employing an efficient and simple method for the purification of the impurity-laden alumina obtained in the dry scrubbing of aluminum reduction cell offgases. The instant process utilizes an ultrasonic treatment of a slurry of the impure alumina which will remove the impurities from the alumina scavenger and allows the return of all of the purified alumina to the reduction cells without requiring additional cleaning and without increasing the impurity level of the produced aluminum metal in a significant degree.

BRIEF SUMMARY OF THE INVENTION

A process for the removal of metallic and/or nonmetallic impurities from contaminated alumina employed as scavenger in the dry scrubber system of aluminum reduction cell effluent treatment comprising the preparation of a slurry containing from about 5 to about 35% by weight contaminated alumina scavenger, subjecting the slurry to an ultrasonic treatment at a frequency in excess of about 10kHz, to remove impurities from the scavenger, followed by separation of the impurity-containing liquid phase from the purified alumina. The purified alumina can, after a thermal treatment, be charged to the aluminum reduction cells as feed without any additional purification step. Addition of a surfactant to the slurry can improve the separation of the liquid phase from the purified alumina. Classification of the contaminated alumina by size prior to ultrasonic treatment allows reduction of the quantity of alumina to be purified.

DETAILED DESCRIPTION OF THE INVENTION

Figure 1:
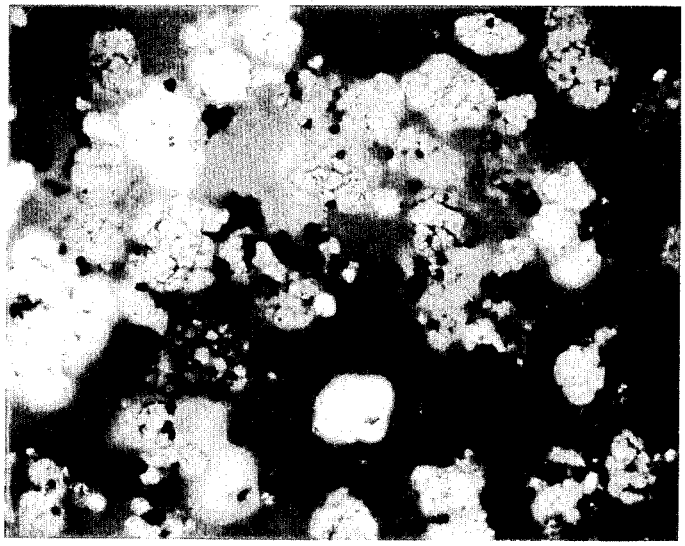
FIG. 1 shows a micrograph of an impurity-laden alumina scavenger at a 200 time magnification.

The present invention relates to the purification of contaminated alumina scavengers of dry scrubber systems, such as employed in the scrubbing of aluminum reduction cell effluent. More particularly, it relates to a process wherein impurity-laden alumina scavengers are subjected in slurry form to an ultrasonic treatment which removes a significant portion of the impurities from the alumina and allows the recycle of the treated alumina to the reduction cells.

In the Hall-Heroult process of producing aluminum by the electrolytic reduction of alumina, alumina is generally charged to cells which have a carbon bottom covered by a layer of molten aluminum which forms the cathode. To establish an electrical current through the cell carbon anodes are used which can be either prebaked or Soederberg anodes. Since alumina is a nonconductive compound, a molten, electrically conductive salt bath, generally a fluoridic salt, such as cryolite ($Na_3AlF_6$) is employed to provide a conductive medium as well as a solvent for the alumina at the temperature of reduction. The combination of the molten fluoridic salt and the alumina during electrolysis allows the decomposition of the alumina ($Al_2O_3$) to metallic aluminum and oxygen. The oxygen combines with the carbon of the anodes to produce mainly carbon dioxide and this generated carbon dioxide forms a large volume of the effluent emanating from the reduction cells. Although cryolite is a very stable compound, under the conditions of electrolysis some dissociation to fluoridic compounds, i.e. $AlF_3$ and NaF takes place. In the presence of water vapor, which is always present in the cells due to the water content of air and of the alumina feed (which is generally quite low) generation of hydrogen fluoride occurs by reaction of the water with the fluorides. Water vapor can also be generated by the anodic oxidation of the hydrocarbon content of the anodes. Consequently, the effluent leaving the cell will have a significant HF content. In addition, a portion of the free hydrogen fluoride may react with some of the metal impurities present in the feed alumina, thus forming volatile fluorides which also escape from the cell. The effluent generated by the electrolysis also contains dust, most of which is finely distributed alumina with carbon and particulate fluorides as additional components. Thus, it can be seen that the effluent of the reduction cell is unsuitable for direct release to the atmosphere and consequently purification of it is a prerequisite to disposal.

A suitable method of reduction cell effluent purification involves the use of a dry scrubbing system. These systems are well-known in the art and are described in several United States Pats., for example in No. 3,503,184 (Knapp et al), No. 3,790,143 (Nix) and No. 3,827,955 (Bahri et al). Regardless of the mechanical differences existing in the dry scrubber designs employed for the purification of reduction cell offgases, all designs have a common feature which is the utilization of alumina as scavenger in the effluent scrubbing systems. The alumina employed for scrubbing surfaces is characterized by a sorptive surface and most commonly reduction grade alumina is utilized. The composition of a typical reduction grade alumina is shown in Table I.

Table I

| TYPICAL REDUCTION GRADE ALUMNA | |
|---|---|
| Element | Percent by weight* |
| Si | 0.007 |
| Fe | 0.011 |
| Na | 0.32 |
| Ca | 0.025 |
| Zn | ≦0.001 - 0.01 |
| Mn | ≦0.0002 - 0.0006 |
| Ti | ≦0.001 - 0.002 |
| V | <0.001 - 0.002 |
| $P_2O_5$ | 0.001 - 0.004 |
| Mg | ≦0.001 - 0.003 |
| Ga | 0.001 - 0.01 |
| Others | <0.001 |
| | Balance $Al_2O_3$ |

*Dry basis after ignition after 1 hour at 1000° C.

In general, the alumina utilized for dry scrubbing purposes is characterized by a sorptive surface which can be expressed in surface area as measured by the Brunauer-Emmett-Teller (BET) method. Thus, for effective scrubbing aluminas are preferred which have a BET surface of about 25 $m^2/g$ or higher, generally in the range of about 25–400 $m^2/g$. Representative examples of suitable aluminas include reduction grade alumina, active alumina and also hydrated alumina ($Al_2O_3 \cdot 3H_2O$).

In the operation of the dry scrubbers the alumina scavenger in contact with the reduction cell effluent is usually allowed to sorb only a certain predetermined quantity of fluoride and when this predetermined limit is attained the effluent is contacted with fresh alumina. The reason for not allowing the alumina scavenger to reach equilibrium conditions is to avoid break-through which can result in release of unpurified effluent to the atmosphere. Also, when the alumina is allowed to sorb the maximum quantity of fluoride its surface is capable of removing from the effluent, if this alumina is recycled to the reduction cell, the high fluorine content of it may upset the cell operating conditions resulting in reduced operating efficiency. The predetermined fluoride level can vary from one reduction facility to another and also within an individual facility from pot line to pot line. Thus, determination of the desired sorbed fluoride level depends on the operating parameters of the facility utilizing a dry scrubber system for the purification of the reduction cell effluents.

In addition to the sorption of gaseous fluorides from the effluent the scavenger also removes other volatilized compounds and particulate matter from the offgases. Depending on the purity of the alumina employed for the feeding of the reduction cells, the type of anodes utilized, the operation conditions and the extent of recycle of the contaminated scavenger to the cells, the type and quantity of the contaminants trapped by the scavenger in the dry scrubber can vary within wide limits. However, it can be generally stated that in all cases the alumina scavenger during the scrubbing operation becomes significantly enriched in metallic and nonmetallic impurities, such as Fe, Ni, V, Ca, Mg, Na, Si, carbon and $P_2O_5$. Table II shows the extent of pick-up of these impurities by a typical reduction grade alumina charged to a conventional dry scrubber system.

Table II

Comparison of the impurity content of fresh reduction grade alumina charged to a dry scrubber system and the contaminated alumina removed therefrom

| Element | Impurity level of $Al_2O_3$ charged to scrubber, % by wt. | Impurity level of $Al_2O_3$ removed from scrubber after use; % by wt. |
|---|---|---|
| Fe | 0.013 | 0.094 |
| Si | 0.011 | 0.014 |
| Cu | <0.01 | <0.01 |
| Mg | 0.003 | 0.009 |
| Ni | <0.005 | 0.019 |
| V | 0.001 | 0.005 |
| Ca | 0.014 | 0.058 |
| Zn | 0.002 | 0.002 |
| Mn | <0.002 | <0.002 |
| Ti | 0.002 | 0.002 |
| Ga | 0.011 | 0.013 |
| Cr | <0.001 | <0.001 |
| Na | 0.48 | 0.66 |
| C | <0.05 | 1.70 |
| $P_2O_5$ | 0.001 | 0.012 |

It can be readily observed from Table II, that there is a considerable increase in undesirable metallic and nonmetallic impurity content in the contaminated scavenger and recycle of this impurity-laden alumina to the reduction cell will have a harmful effect on the aluminum metal produced from the electrolytic decomposition of such impure alumina. Even if the ratio of fresh alumina: recycle alumina charged to the pot line is adjusted in a manner to avoid large scale contamination of the produced metal, due to the continuous recycle of contaminated alumina scavenger to the cells the gradual build-up of undesirable metallic impurity content in the produced aluminum becomes unavoidable.

The present invention offers an efficient means to prevent this undesirable build-up of impurities in the produced metal by providing a process which can readily remove the accumulated impurities from the contaminated alumina scavenger. The instant process involves the ultrasonic treatment of the impure alumina in slurry form, preferably in an aqueous slurry although polar or nonpolar organic solvents are equally suitable for the preparation of the slurry.

In order to achieve the purposes of the present invention the contaminated scavenger is slurried, preferably in an aqueous medium. The solids content of the slurry is usually determined by two main factors which involve technical feasibility and economical considerations. Thus, it has been found that slurry solids concentrations above about 60–70% by weight pose technical difficulties relating to the handling and transfer of such heavy slurries, while slurry concentrations below about 3% by weight are too dilute for economical reasons. For best results the present process utilizes slurries having a solids content in the range of about 5 to 35% by weight.

It has been further found that the removal of metallic and/or nonmetallic impurities from the contaminated alumina scavenger may be aided by the incorporation of a small quantity of surface active agent in the slurry. The surface active agent added can be of anionic, cationic or nonionic character, or mixtures of these. These types of surfactants are well-known in the art. The quantity of surfactant incorporated in the slurry is generally small and is usually added in the range of about 0.01 to about 2% by weight of the solids content of slurry. Addition of the surfactant is optional, outstanding results are obtained without its incorporation in the slurry.

The slurry containing the contaminated alumina scavenger is then subjected to the ultrasonic treatment of the present invention.

The ultrasonic treatment can be accomplished in conventional equipment, such as a horn or a cavitation box, using a high frequency oscillator capable of generating frequencies of at least about 10 kHz. Suitable equipments generate frequencies in the range of about 10–90 kHz.

If the solvent employed for the preparation of the slurry is an organic liquid in some cases, particularly where the solvent has a low boiling point, i.e. less than about 70° C, the ultrasonic treatment is preferably accomplished under pressure. The pressures employed are usually selected in a manner to avoid boiling of the solvent during the ultrasonic treatment.

The time required for the treatment usually depends on the frequency employed and on the power applied per square unit. It has been found that rapid and efficient purification can be achieved when the frequency applied to the slurry is within the range of about 10–60 kHz and the power level is in the range of about 0.5–200 watts/cm$^2$. Under these operating conditions satisfactory purification of the contaminated alumina scavenger in a slurry of 5–35% solids content can be obtained in less than about 5 minutes, usually in less than about 1 or 2 minutes.

Subsequent to the ultrasonic treatment the liquid phase is removed from the solids. This can be accomplished by the use of conventional separation apparatus, such as by employing centrifuges or clarifiers. After removal of the slurrying medium from the purified alumina, the alumina can be subjected to a thermal treatment mainly to remove its residual solvent content or if desired to restore its active surface area. The thermally treated purified alumina can then be readily employed as feed for the reduction cells or if desired reused for scrubbing. Table III shows the effect of the treatment on contaminated alumina scavenger.

Figure 2:
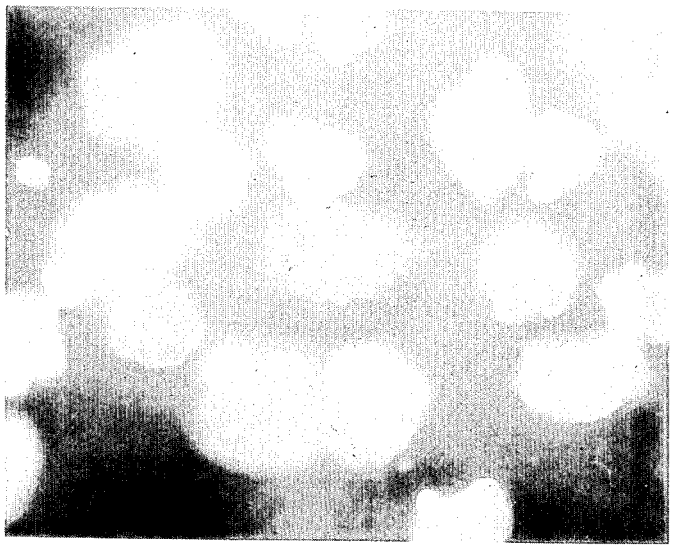
FIG. 2 shows a micrograph of an ultrasonically treated, purified alumina scavenger at the same magnification.

It has been observed that the contaminated alumina scavenger prior to the ultrasonic treatment in slurry form has a distinctly gray-black coloration. However, subsequent to the ultrasonic treatment the original white color of the alumina is restored and the aqueous phase, which is removed after the ultrasonic treatment will have a black color due to the presence of finely dispersed impurities removed from the alumina scavenger. From FIG. 1, depicting a contaminated alumina scavenger, it can be seen that a major quantity of the impurities appearing as dark areas within the white alumina scavenger is dispersed within the alumina scavenger particles. FIG. 2, which shows the purified alumina scavenger, indicates the disappearance of these black areas. While no theories are being postulated for the effective purification obtained by the ultrasonic treatment it is believed that the treatment causes the breakdown of the trapped impurities allowing them to be dispersed in the aqueous phase and subsequently removed during the separation step. Apparently, the ultrasonic treatment does not materially affect the alumina particle size, it preferentially acts only on the entrapped impurities.

Table III

Effect of Ultrasonic Treatment on Contaminated Alumina Scavenger

| Element | Contaminated Alumina Impurity level % by weight | Purified Alumina Impurity level % by weight |
|---|---|---|
| Fe | 0.100 | 0.014 |
| Ni | 0.02 | not detected |
| V | 0.005 | not detected |
| Cu | 0.005 | not detected |
| Na | 1.00 | 0.20 |
| $P_2O_5$ | 0.020 | 0.003 |
| C | 1.70 | 0.08 |

From Table III the effective purification attained by the ultrasonic treatment of the contaminated alumina scavenger can be readily concluded.

It has been also found that the major portion of the contaminants is associated with the finer fraction of alumina scavenger. For example, if the contaminant-laden alumina scavenger is classified by particle size to a fraction of more than 40 micron size and a fraction of less than 40 microns, analysis for contaminants indicate that the major quantity of impurities will be in the less than 40 micron fraction. Since a major portion of the alumina employed in dry scrubber systems has a particle size in excess of about 40 microns usually more than about 80% by weight of the alumina possesses a particle size of 40 microns and above, it is possible to classify the alumina prior to ultrasonic treatment to coarse (>40 micron) and fine (<40 micron) fractions. After classification the coarse fraction can be subjected to the ultrasonic treatment, while the fine fraction may either be used for other purposes or be subjected to an additional classification to obtain a 10–40 micron fraction and a less than 10 micron fraction. The 10–40 micron fraction of the fines constitutes about 75–80% of the fines and to avoid losses of alumina, this fraction may also be subjected to ultrasonic treatment, while the less than 10 micron fraction can be used for other purposes after a pyrohydrolysis treatment, such as is known in the prior art. Table IV indicates the distribution of contaminants in the classified contaminated alumina scavenger.

Table IV

Distribution of Impurities in Classified, Contaminated Alumina Dry Scrubber Scavenger

| Fraction | >40μ | 40–10 μ range | <10 μ | Total Alumina |
|---|---|---|---|---|
| Wt % of total | 87 | 12 | 1.0 | 100 |
| Element | % by weight | % by weight | % by weight | % by weight |
| Fe | 45 | 37 | 18 | 0.094 |
| Ni | 24 | 53 | 23 | 0.019 |
| V | 58 | 29 | 13 | 0.005 |
| $P_2O_5$ | 49 | 38 | 13 | 0.012 |
| Ca | 30 | 52 | 19 | 0.058 |
| Mg | 46 | 41 | 14 | 0.009 |
| Na | 43 | 48 | 10 | 0.66 |

From Table IV it can be observed that with the exception of the vanadium contaminant, more than 50% of the total impurity content of the contaminant-laden alumina is in the less than 40 micron fraction which in the instant case constitutes only about 13% of the total alumina weight. Thus, classification of the contaminated alumina in coarse and fine fractions, followed by ultrasonic treatment of the coarse fraction may only provide an optional, but particularly advantageous embodiment of the instant invention.

The following Example is presented to provide further details illustrating the novel aspects of the present invention without intending to limit the scope thereof.

EXAMPLE

Contaminated alumina scavenger, which has been removed from the dry scrubber system of an aluminum reduction plant effluent treating facility, has been subjected to the ultrasonic purification process of the instant invention. The contaminated alumina scavenger had a particle size distribution wherein more than about 95% of the particles were more than 44 micron in size. The impurity content of the contaminated scavenger was as follows: Fe 0.094%, Si 0.014%, Cu 0.005%, Mg 0.009%, Ni 0.0186% , V 0.005%, Ca 0.056%, Zn 0.0011%, Ti 0.002%, Ga 0.013%, C 1.7%, $P_2O_5$ 0.020% and Na 0.48% (all percentages by weight of the alumina). An aqueous slurry of about 15% by weight solids concentration was prepared by uniform dispersion of 50 grams of the impure alumina in water. This slurry was then subject to ultrasonic treatment using a Branson Automatic Cleaner, Model D-50 cavitating apparatus at 45 kHz at 0.6 W/cm$^2$ for about 30 seconds. Subsequently, the slurry was allowed to settle and then the supernatant aqueous phase containing dispersed black particles was separated from the treated alumina by decantation. After washing of the treated alumina it was dried at about 140° C and 44.09 grams of purified alumina of the following composition were recovered: Fe 0.014%, Si 0.010%, Cu not detected, Mg 0.001%, Ni not detected, V not detected, Ca 0.02%, Zn 0.0009%, Ti 0.002%, Ga 0.012%, C 0.08%, $P_2O_5$ 0.003%, and Na 0.2% (all percentages are percent by weight). The decanted supernatant was then filtered and the black colored solids recovered on the filter were dried. The black solids, amounting to 4.34 grams, consisted mainly of the impurities removed from the alumina by the ultrasonic treatment together with a small quantity of alumina which remained dispersed in the supernatant and was decanted with the impurities. The quantity of alumina removed with the supernatant can be reduced to an insignificant quantity by using a centrifuge for separation of the liquid phase from the treated alumina. The above data indicates the excellent purification efficiency of the instant ultrasonic treatment.

Addition of a small quantity (about 0.1% by weight of the solids content of the aqueous slurry) of nonionic surfactant, such as a sulfonated fatty acid, improved the wetting of the black solids in the supernatant and aided in settling and separation thus reducing the quantity of alumina removed with the supernatant when a decantation process was employed for the separation of the aqueous medium from the purified alumina.

The instant process as described herein is capable of removing significant quantities of sorbed impurities from the contaminated alumina scavengers. The degree of removal is entirely within the discretion of the operator and can vary within wide limits depending on the ultrasonic treatment conditions utilized and on the requirements of the aluminum reduction plant with regard to the desired purity of the feed, the composition of the bath in the reduction cell and the purity of the metal to be produced. It can, however, be stated that in general the instant process is capable of removing up to about 80–85% of the sorbed Fe and Na content and also more than about 90% of the sorbed Cu, Ni and V content of the contaminated alumina is removable. The degree of possible removal for the C and $P_2O_5$ content of the contaminated scavenger also exceeds about 80%.

What is claimed is:

1. In the process of removing metallic and nonmetallic impurities from contaminated alumina scavengers recovered from dry scrubber systems used for purification of aluminum reduction cell effluents, the improvement which comprises preparing a slurry from the contaminated alumina scavenger and a liquid selected from the group consisting of water, polar and nonpolar organic solvents, subjecting the slurry to an ultrasonic treatment at a frequency of at least about 10 kHz for a time period sufficient to remove a desired quantity of metallic and nonmetallic impurities from the alumina scavenger, separating the liquid containing these impurities in dispersed form from the treated scavenger, recovering purified solid alumina of significantly reduced impurity content and recycling the purified alumina to the aluminum reduction cell or to the dry scrubber system.

2. Process according to claim 1, wherein the slurry has a solids content in the range of about 5 to 35% by weight.

3. Process according to claim 1, wherein the slurry also contains a nonionic, anionic or cationic surfactant in an amount in the range of about 0.01 to about 2% by weight of the solids content by the slurry.

4. Process according to claim 1, wherein the contaminated alumina scavenger is slurried in water.

5. Process according to claim 1, wherein the contaminated alumina scavenger is slurried in an organic solvent.

6. Process according to claim 5, wherein the ultrasonic treatment of the organic solvent-contaminated alumina slurry is accomplished under a pressure sufficient to prevent boiling of the solvent during the treatment.

7. Process according to claim 1, wherein an aqueous slurry of about 5 to about 35% by weight solids content is prepared from the contaminated alumina scavenger and the slurry is ultrasonically treated for a time period of less than about 5 minutes at a frequency in the range of about 10–60 kHz and at a power input of 0.5–200 $W/cm^2$.

8. Process according to claim 1, wherein the contaminated alumina scavenger is classified prior to slurrying to a more than 40 micron fraction and to a less than 40 micron fraction and the ultrasonic treatment is applied to a slurry prepared from the more than 40 micron fraction of the contaminated alumina.

9. Process according to claim 1, wherein the purified alumina is thermally treated and then employed as feed for aluminum reduction cells.

* * * * *